United States Patent [19]

Maopolski

[11] 3,953,018

[45] Apr. 27, 1976

[54] COLLATING APPARATUS

[75] Inventor: Bernard J. Maopolski, Easton, Pa.

[73] Assignee: Harris Corporation, Cleveland, Ohio

[22] Filed: June 3, 1974

[21] Appl. No.: 475,576

[52] U.S. Cl. ..... 270/55
[51] Int. Cl.[2] ..... B65H 5/30
[58] Field of Search ..... 270/55, 54, 56, 58; 271/258–261

[56] References Cited

UNITED STATES PATENTS

| | | | |
|---|---|---|---|
| 2,892,627 | 6/1959 | Newhouse | 270/55 |
| 3,263,991 | 8/1966 | Singh | 271/258 |
| 3,816,866 | 6/1974 | Miaskoff | 270/56 |

*Primary Examiner*—Edgar S. Burr
*Assistant Examiner*—A. Heinz

[57] ABSTRACT

A newspaper stuffer for inserting newspaper sections into newspaper jackets including pockets movable along a path and stationary bottom-feed hoppers spaced along the path of the movable pockets. Also included are first and second feed hoppers each adapted to hold a supply of jackets and positioned in generally side-by-side relationship wherein separate first and second jacket feed means are respectively associated with the first and second feed hoppers for withdrawing jackets from the associated hopper and supplying the withdrawn jackets to the circulating pockets. Further, associated with the jacket feed means is a control means for sensing failure of the first feed means to supply a jacket to a pocket and subsequently actuating the second feed means to supply a jacket to the pocket missed by the first feed means.

4 Claims, 4 Drawing Figures

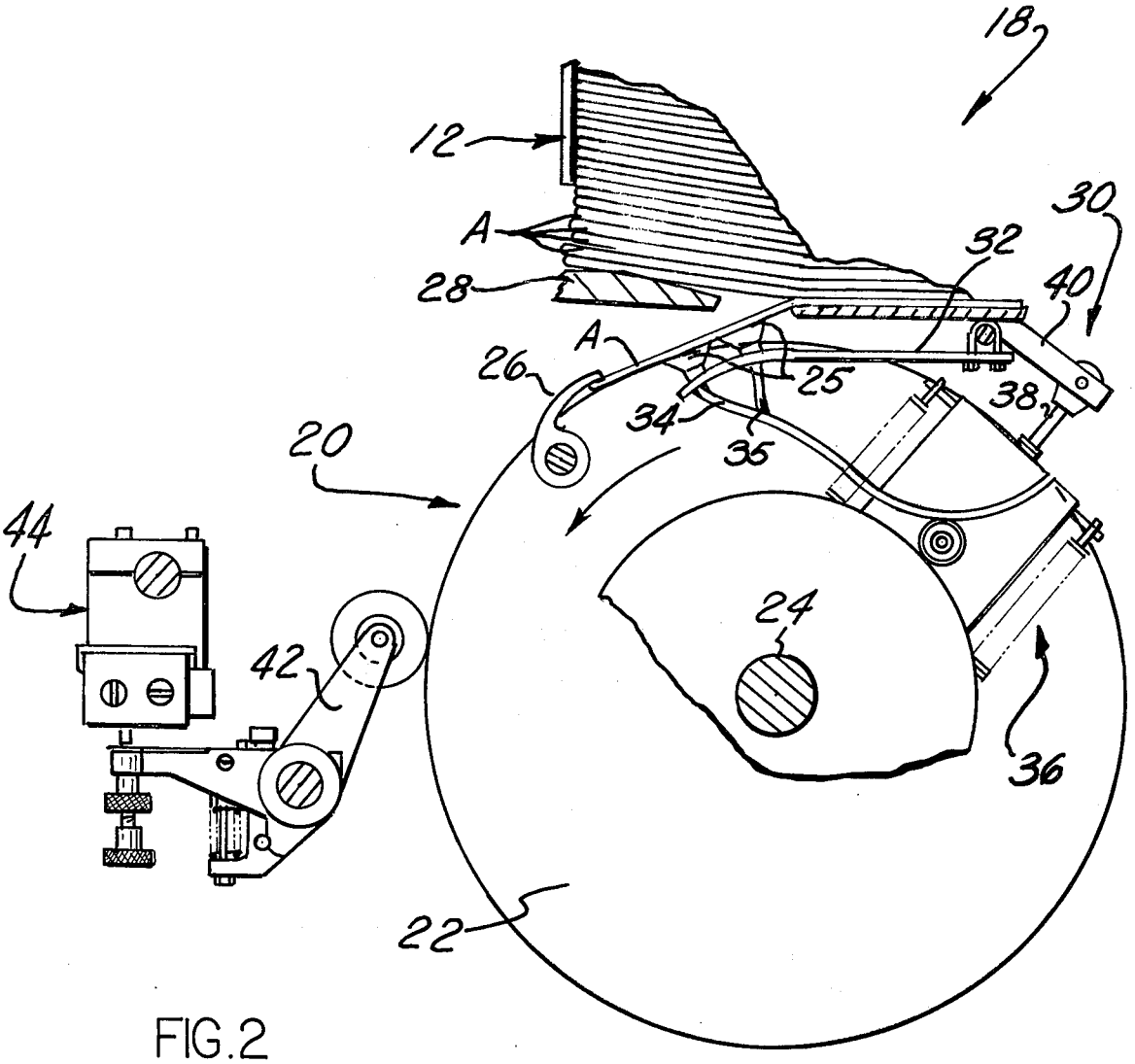
FIG.2
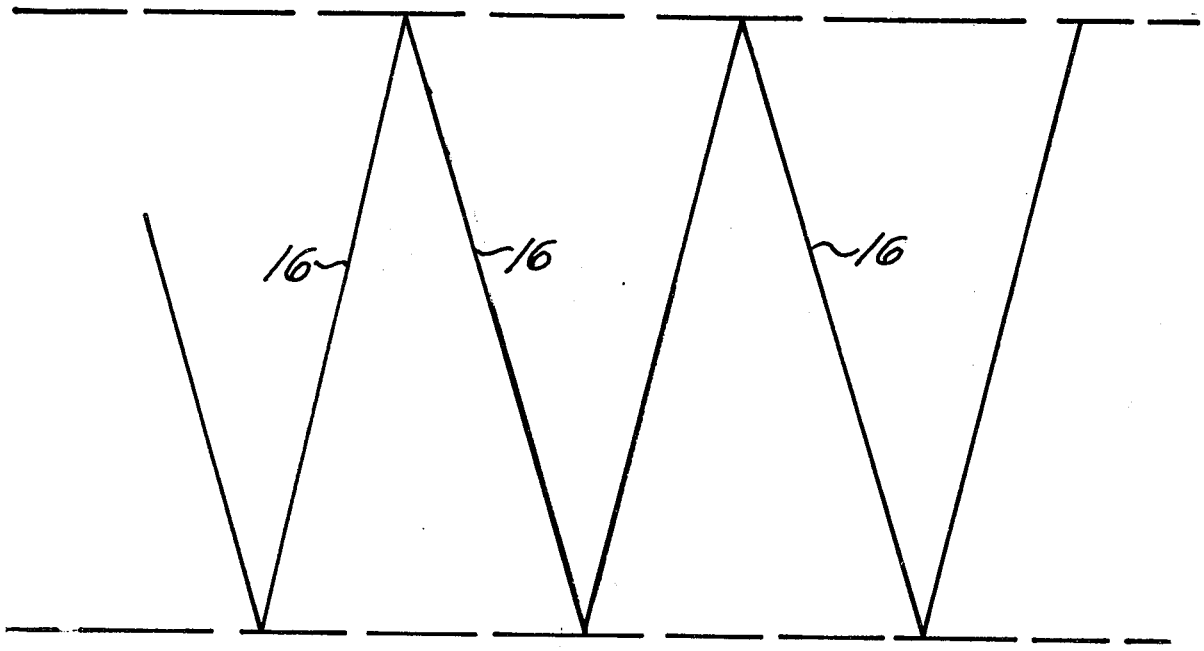

COLLATING APPARATUS

BACKGROUND OF THE INVENTION

The subject invention is directed toward the art of associating newspaper sections, commonly referred to in the trade as "stuffing." Typically, stuffing machines are comparatively complex machines which have a relatively low output when compared to the modern high-speed printing press. The machines' mechanical complexity and the attendant necessity of shutdown to correct mechanical malfunctions has, together with the comparatively low output, made it difficult to directly connect the high-speed press output with stuffing machines. Consequently, the machines have generally been hand loaded and operated independently of the presses.

In the commonly-assigned, copending application Ser. No. 227,184, filed Feb. 17, 1972, there is disclosed a method and apparatus by which stuffing machines can be directly associated with printing presses through the use of suitable conveyor and accumulating systems. The conveyor and accumulating systems disclosed in the noted patent application permit continued operation of either the press or the stuffing system for a period of time even when a breakdown or stoppage occurs in the other machine.

The subject invention provides an additional improvement to a stuffing machine such that the stuffing machine itself has a capability of continuing operation even though certain portions thereof have malfunctioned.

BRIEF DESCRIPTION OF THE INVENTION

Generally, in accordance with one aspect of the subject invention, a newspaper stuffer of the type used for inserting newspaper sections into printed newspaper jackets and having moving pockets and stationary hoppers spaced along the path of movement of the pockets is provided with at least a first hopper and a second hopper positioned in generally side-by side relationship and each adapted to hold a supply of the jackets. Each of the first and second hoppers is provided with feed means independently operable for withdrawing jackets from the associated hopper and supplying the withdrawn jackets to the moving pockets. According to the invention, control means are interconnected between the feed means for the first and second hoppers for sensing failure of the first feed means to supply a jacket to a pocket. The control means also include means operable upon sensing of such a "miss" to actuate the second feed means to supply a jacket to the pocket missed by the first feed means.

In the preferred embodiment, the feed means includes a conventional drum-type feeder which, together with a vacuumwithdrawal system, removes the newspaper jackets from the hopper and deposits them into the pockets. In accordance with a further aspect of the subject invention, the drum of the second feed means is rotated continually in timed relationship with the movement of the pockets. Upon sensing of a miss by the first feed means, controls are actuated to actuate the vacuum feeding system to the second feed means so that it can immediately feed a newspaper jacket to the missed pocket. By having the second feed means continually operating except for actuation of its vacuum system, there is no requirement of a time delay or the like to permit the feed means to obtain operating speed.

As is apparent from the foregoing, the subject invention can be used with a stuffer and accumulator system which is directly connected to a high-speed press, as shown in the noted application. Additionally, either one or both of the jacket hoppers can be hand loaded. Moreover, although the invention will be described with particular reference to its use in a rotary or circulating stuffing machine, it could, of course, be incorporated in other types of machine.

BRIEF DESCRIPTION OF THE DRAWINGS

The above-discussed objects and advantages of the invention will become apparent from the following detailed description of a preferred embodiment wherein:

FIG. 2 is an elevational view taken generally along line 2—2 of FIG. 1 and illustrating a first stuffing hopper and feed means for supplying newspaper jackets from the hopper to the pockets;

DETAILED DESCRIPTION OF THE PREFERRED EMBODIMENTS

Figures 1, 3:
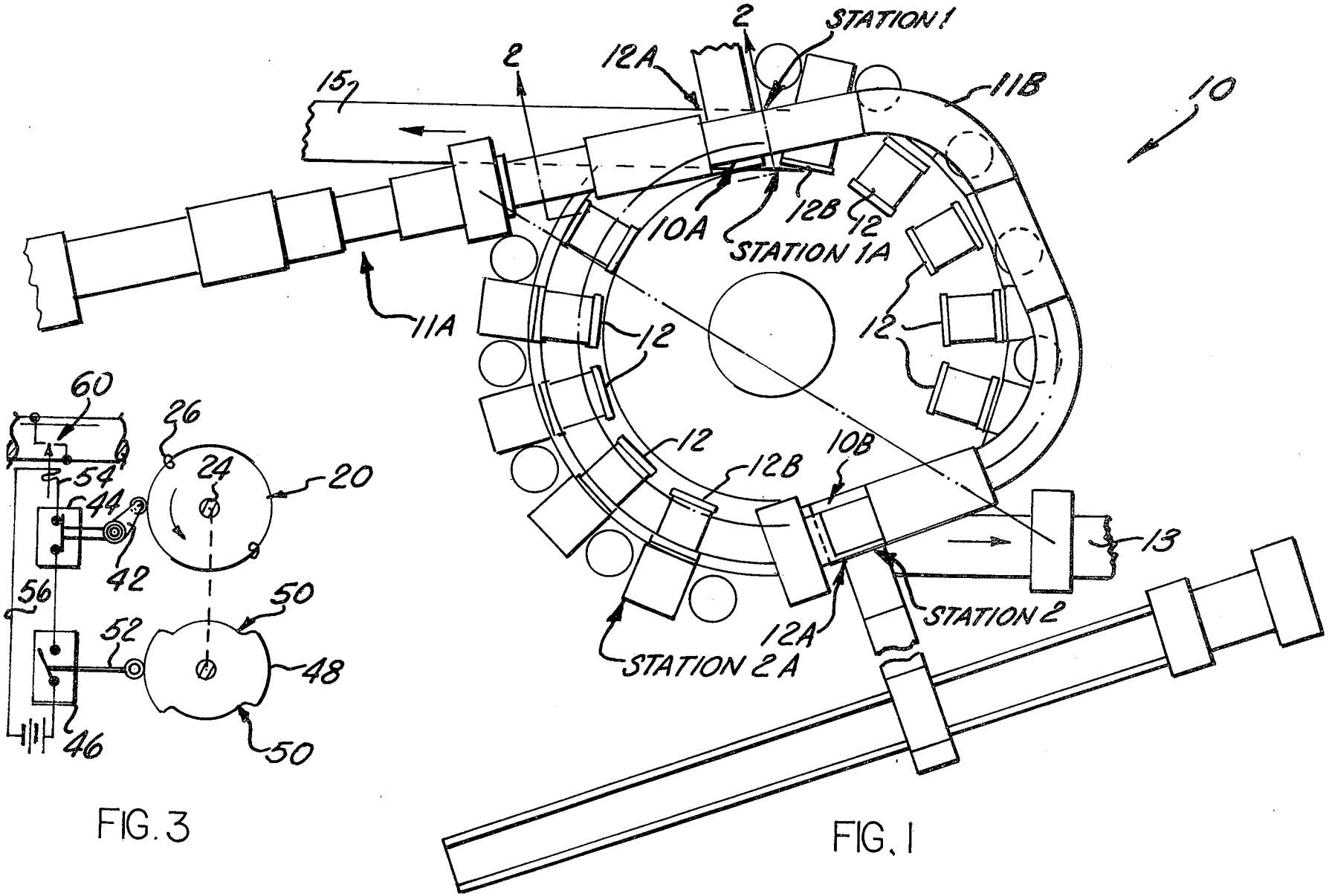
FIG. 1 is a simplified plan view of a rotary stuffing machine incorporating the subject invention.
FIG. 3 is a somewhat schematic control diagram showing a control means used for actuating the second feed mechanism in response to a miss by the first feed mechanism.

Referring more particularly to the drawings wherein the showings are for the purpose of illustrating a preferred embodiment of the invention only, and not for the purpose of limiting same, FIG. 1 shows the overall arrangement, in plan view, of a rotary stuffing system 10 incorporating the subject invention. Broadly, the stuffing system 10 is of the general type more particularly shown and described in U.S. patent application Ser. No. 227,184, filed Feb. 17, 1972 for "Combined Newspaper Press and Stuffer, and Method of Forming Newspapers Therewith." It should, of course, be understood that many different stuffers having different structural arrangements could equally well have the subject invention incorporated therein. The details of the stuffer system 10 are disclosed and described in the noted application, and the specification thereof is incorporated herein by reference.

Broadly, the stuffing system 10 includes two 180° sectors of rotary stuffer of the type shown in U.S. Pat. No. 2,634,971, granted to Schweizer on Apr. 14, 1953. In the subject embodiment, the stuffers 10A and 10B are identical and each is provided with a series of open-bottomed hoppers 12. Each of the hoppers 12 carries a feed means 18, as shown in FIG. 2; consequently, for the purposes of this disclosure, a description of feed means 18, as shown in FIG. 2, is applicable to the feed means at every hopper 12 except as otherwise noted. Further, each of the hoppers 12 is provided with an automatically filled hopper 12A which receives freshly printed jackets supplied from a press (not shown) by a conveyor 11A. The second stuffer 10B is similarly provided with an automatically filled hopper 12B supplied from the press by a conveyor 11B. During normal operation, newspaper jackets coming from the press will be deposited into both hoppers 12A and 12B. From hopper 12A, the newspaper jackets will be dropped individually into standard pockets 16 of the rotary stuffer. As disclosed in the aforementioned U.S. Pat. No. 2,634,971, the pockets 16 are mounted on a suitable base and travel counterclockwise (as viewed in FIG. 1) to move beneath the hoppers from which they receive the newspaper jackets and inserts to form completed newspapers which are discharged from the pockets onto the conveyors 13 and 15. The pockets are adapted to immediately begin receipt of new newspaper jackets and sections from the next following stuffer.

Referring more particularly to FIG. 2, the means for feeding individual jackets and/or sections from the hoppers to the pockets 16 will be described in some detail. In particular, each of the hoppers 12 is provided with a feed means 18. Broadly, the feed means 18 may be of a variety of constructions and may be of the type shown in the aforementioned U.S. Pat. No. 2,634,971. As shown herein each feed means 18 comprises a rotary extracting drum 20 which includes several disc members 22 mounted on a common shaft 24 near the outlet of the associated hopper. Suitable gripper members 26 are carried on the periphery of the drum 20 between adjacent discs 22. The gripper members 26 are arranged to receive the folded leading edge of the jacket or insert being fed from the hopper 12 to the subjacent pocket 16.

The individual jackets or sections are fed, one at a time, from the hopper 12 to the drum 20 by the interaction of a separating member 28 and a vacuum suction assembly 30. As best shown in FIG. 2, the separating member 28 is mounted adjacent the open bottom wall of the hopper 12 and is moved to permit the vacuum assembly to be actuated upwardly to engage and grip the section or jacket. Thereafter, the vacuum assembly is actuated downwardly to pull the jacket or insert from the hopper. The timing between the actuation of the vacuum assembly and the movement of the member 28 is such that the member 28 engages under the next upper jacket or section and holds it while the lowermost jacket is engaged by the gripper 26 on the drum and pulled out of the hopper.

In the embodiment under consideration, the vacuum assembly 30 comprises a pair of vacuum cup members 25 carried on a suitable pivotally mounted arm 32. The vacuum cups are connected with a source of vacuum lines 34, 35.

It should be understood that the member 28 and the feed drum 20 are driven in timed relationship through conventional mechanical or electrical means, not shown. Similarly, the movement of the vacuum arm 32 is also controlled in timed relationship with the drum 20. In the embodiment under consideration, the vacuum arm is controlled by a cam assembly 36 which includes a cam carried by the shaft of follower 38 which operates off the periphery of the drum 20. The cam assembly is drivingly connected to the arm 32 through a suitable mechanical linkage, such as a crank member 40.

As shown, the feed drum 20 rotates in a counterclockwise direction (as viewed in FIG. 2) and takes the newspaper jacket or section A and deposits it in a subjacent pocket 16. The operation of the pockets 16 is well known and shown, for example, in some detail in the aforementioned U.S. Pat. No. 2,634,971.

As previously mentioned, a feed means 18 is associated with each of the hoppers 12. Thus, a complete newspaper or portion thereof can be assembled in the jackets and sections being suitably supplied from the hoppers to the pockets 16 as they move past the hoppers.

As discussed earlier, stuffers of the general type described normally include means for sensing a miss on the part of any particular feed assembly. Typically, upon sensing of a miss (which may indicate an empty hopper or a mechanical malfunction) the machine automatically signals and is either manually or automatically shut down until the malfunction can be corrected.

In the commonly-assigned, copending application Ser. No. 227,184, filed Feb. 17, 1972, for "Combined Newspaper Press and Stuffer, and Method of Forming Newspapers Therewith," the disclosed system includes accumulating capacity such that during a shutdown of the stuffer, the press output can be accumulated and upon correction of the malfunction of the stuffer, the stuffer restarted without requiring a press slowdown or a substantial amount of manual handling of the papers or sections.

In the subject device, the stuffer is arranged such that at least two of the hoppers 12 are adapted to hold jackets. Referring to FIG. 1, it will be seen that the first two hoppers 12A and 12B of each stuffer 10A and 10B (labeled stations 1 and 1A) are, according to the subject invention, adapted to hold jackets. As noted earlier, in the subject embodiment, the first hopper of each stuffer 12A is automatically fed from the press and associated with the accumulator system. The second hopper 12B of each is a manually loaded hopper. The hopper 12B can also be fed by a variety of mechanical methods.

In accordance with the subject invention, the first feed means at station 1 of stuffer 10A is provided with means to sense a "miss" (failure to feed a jacket to the subjacent pocket). The sensing means is interconnected with the vacuum feed system of the feed means 18 of the second feed means at station 1A. Preferably, the feed means 18 of station 1A is continually operated except for the operation of the vacuum system 30. The interconnection between the sensing means at station 1 and the vacuum system at station 1A is such that upon sensing of a miss, the vacuum system 30 of station 1A is actuated. Consequently, station 1A is thus actuated to supply a jacket to the subjacent pocket which has been missed at station 1. Further, in the subject embodiment, the first two hoppers 12A and 12B of stuffer 10B, as shown at station 2 of FIG. 1, are adapted to hold jackets. In the subject embodiment, station 1 is substantially identical to station 2 and station 1A is substantially identical to station 2A; consequently, the above disclosure relating to stuffer 10A is equally applicable to stuffer 10B, except as otherwise noted.

Many different types of control setups, either mechanical or electrical, could be provided to carry out the noted functions. Specifically, in the subject embodiment, the preferred control means comprise a sensing cam arm 42 which is suitably mounted adjacent the feed drum 20 of station 1. The cam is interconnected with a microswitch 44. In the setup illustrated in FIG. 3, the cam arm is arranged so that the switch 44 is opened when a jacket is present on drum 20. Absence of a jacket allows the switch 44 to remain closed. Connected in a series with switch 44 is a second switch 46 operated from a cam 48. Cam 48 is driven simultaneously with drum 20. As shown, the cam 48 includes cutout cam portions 50 which correspond to the location of a jacket on the feed drum 20. As shown, the cam 48 includes cutout cam portions 50 which correspond to the location of a jacket on the feed drum 20. Switch 46 is closed whenever the cam portions 50 pass the follower 52. As can be seen, so long as a jacket is present on drum 20, switch 44 will be opened whenever switch 46 is closed. However, if a jacket is not present on drum 20 when switch 46 is closed, then switch 44 will also be closed and a circuit will be completed through lines 54, 56. Completion of a circuit through the noted lines opens a solenoid valve 60 which allows a vacuum to be drawn on the vacuum assembly 30 of the feed means 18 at station 1A of stuffer 10A and/or station 1A of stuffer 10B. Thus, for whatever reason a jacket is not supplied from hopper 12A of station 1, a jacket will be supplied from station 1A. This permits the stuffing operation to continue, even though the press has stopped feeding the hopper 12A or a malfunction has occurred in the accumulating system or the feeding of station 1.

Figure 4:
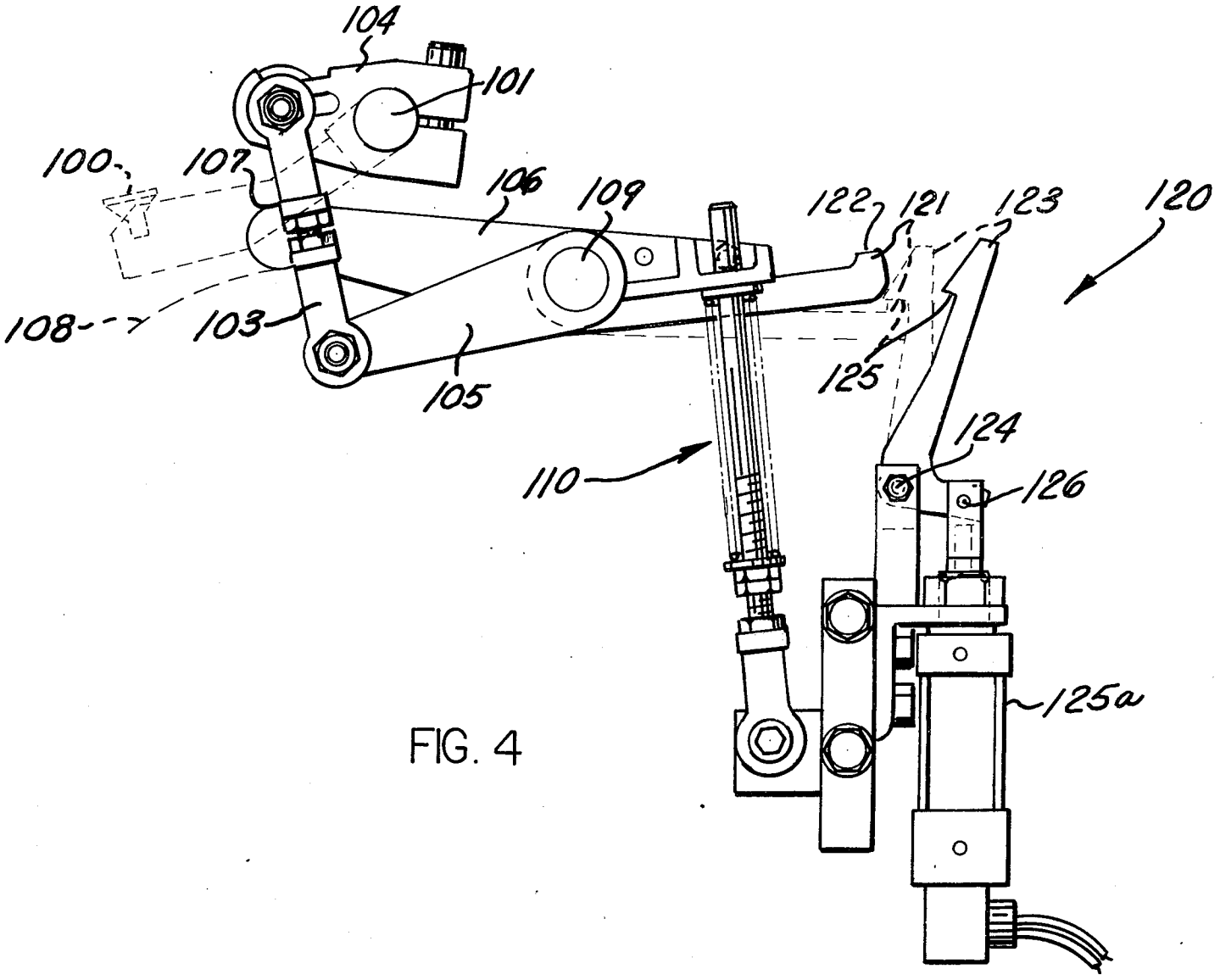
FIG. 4 is a view of another embodiment of the present invention.

Another embodiment of the present invention is illustrated in FIG. 4. In this embodiment, a sucker 100 moves about the axis of a shaft 101 in one direction into engagement with a signature in a hopper, grips the signature, and moves in the opposite direction to remove the signature from the hopper for gripping by a gripper, such as gripper 26 in the embodiment of FIG. 1. The sucker 100 is moved about the axis of the shaft 101 upon movement of an adjustable link 103 which is connected at one end to a bracket 104. The bracket 104 is connected to the shaft 101. The other end of the link 103 is connected to an arm of a bracket 105. The bracket 105 has a second arm 106 extending therefrom on which a cam follower 107 is mounted. The cam follower 107 engages the periphery of a cam 108 and is moved about an axis 109 by the cam 108. A suitable spring mechanism, generally designated 110, engages the bracket 105 and biases the cam follower 107 into engagement with the outer periphery of the cam 108. In addition, it should be apparent that as a high of the cam 108 engages the cam follower 107, the sucker member 100 moves upward into engagement with a signature and as the high leaves the cam follower 107, the sucker moves downwardly relative to the signatures in the hopper to withdraw a signature from the hopper.

In accordance with the present invention, the mechanism shown in FIG. 4 is located at the alternate jacket feed station and is constructed so as to inhibit movement of the sucker member 100 during normal operation of the mechanism. This inhibiting action is effected by a latch mechanism, generally designated 120. The latch mechanism 120 includes a latch member 121 which is securely fastened on the bracket 105 and which has a latch surface 122. A cooperating latch member 123 is pivoted about a pivot axis 124 and when in the latch position shown in dotted lines in FIG. 4, has a surface 125 which engages the surface 122 of the latch member 121. The mating engagement of the surfaces 122, 125 prevents the bracket member 105 from moving downwardly under the action of the spring mechanism 110 and the sucker member 100 is held in an up position in which it supports the pile of signatures in the hopper.

In the event of failure of the first jacket feed hopper to feed a jacket into the pocket 16, the sensing mechanism, such as 42 in the embodiment of FIG. 2, triggers energization of an air cylinder 125*a*. The air cylinder 125*a* is connected at 126 to the latch member 123. The air cylinder 125*a* is constructed so as to effect pivoting movement of the latch member 123 about its pivot axis 124, thereby enabling the vacuum sucker 100 to move in a downward direction to feed signatures from the adjacent or alternate jacket feed station.

The shape of the surfaces 122, 125 is such that disengagement of these surfaces cannot occur until the high of the cam 108 engages the cam follower 107. When this occurs, the pressure of the engagement between surfaces 122, 125 is relieved because of the fact that the high on the cam 108 tends to move the surface 122 away from the surface 125. When the pressure is relieved, the pressure in the air cylinder is great enough to effect pivoting action of the latch member 123 to its full-line position in FIG. 4. Until the aforementioned relief of the pressure engagement between the surfaces 122, 125 occurs, the air pressure in the air cylinder 125 is not sufficient to overcome that engagement and pivoting of the latch member 123 does not occur. Accordingly, the latch member 123 is pivoted at the time the high on the cam 102 engages the cam follower 107. As a result, immediate downward movement of the vacuum sucker 100 occurs and immediately downward feeding of the bottommost signature in the hopper occurs. Of course, the vacuum applied to the sucker member 100 is maintained at all times and not terminated as in the embodiment described above.

The invention has been described in great detail sufficient to enable one of ordinary skill in the art to make and use the same. Obviously, modifications and alterations of the preferred embodiment will occur to others upon a reading and understanding of the specification and it is our intention to include all such modifications and alterations as part of our invention insofar as they come within the scope of the appended claims.

What is claimed is:

1. In a newspaper stuffer for inserting newspaper sections into a newspaper jacket, said stuffer having pockets movable along a path and stationary bottom-feed hoppers spaced along the path of the pockets and having at least a first and second of said hoppers each adapted to hold a supply of said jackets and positioned in a generally side-by-side relationship, said second hopper being downstream of said first hopper in the direction of movement of said pockets and said first and said second hoppers being in adjacent relationship along said path, separate first and second feed means associated respectively with said first and second hoppers for withdrawing jackets from the associated hopper and supplying the withdrawn jackets to said moving pockets, said first and second feed means including, respective vacuum-actuated first grippers for engaging and withdrawing jackets from said respective hoppers, continuously rotating drums adjacent said respective hoppers, and second grippers carried by said continuously moving drums for receiving signatures from said respective vacuum-actuated first grippers and for supplying the jackets to said moving pockets, control means including means for sensing failure of said first feed means to supply a jacket to a pocket and for actuating said second feed means to supply a jacket to the pockets missed by said first feed means, and said control means including, means for controlling the action of said first gripper means of said second feed means while said second gripper means continuously moves with said drum comprising means for controlling the vacuum supplied to said vacuum actuated first gripper of said second feed means.

2. In a newspaper stuffer for inserting newspaper sections into a newspaper jacket, said stuffer having pockets movable along a path and stationary bottom-feed hoppers spaced along the path of the pockets and having at least a first and second of said hoppers each adapted to hold a supply of said jackets and positioned in a generally side-by-side relationship, said second hopper being downstream of said first hopper in the direction of movement of said pockets and said first and said second hoppers being in adjacent relationship along said path, separate first and second feed means associated respectively with said first and second hoppers for withdrawing jackets from the associated hopper and supplying the withdrawn jackets to said moving pockets, said first and second feed means including, respective vacuum-actuated first grippers for engaging and withdrawing jackets from said respective hoppers, continuously rotating durms adjacent said respective hoppers, and second grippers carried by said continuously moving drums for receiving signatures from said respective vacuum-actuated first grippers and for supplying the jackets to said moving pockets, control means including means for sensing failure of said first feed means to supply a jacket to a pocket and for actuating said second feed means to supply a jacket to the pockets missed by said first feed means, and said control means including, means for controlling the action of said first gripper means of said second feed means while said second gripper means continuously moves with said drum comprising a linkage means for moving said first gripper means, and means for latching said linkage means to prevent movement thereof, and means included in said control means for releasing said latching means to enable movement of said linkage means to occur.

3. A stuffer as defined in claim 2 wherein said linkage means includes a cam follower, a cam engaging said cam follower and having a high portion for actuating said linkage means and which high portion engages said cam follower when said vacuum-actuated first gripper of said second feed means engages a signature in said second hopper, and wherein said means for releasing said latch mechanism is operable to effect said release when said high portions on the cam engages the cam follower for actuating the means linkage.

4. A stuffer as defined in claim 3 further including a spring means for biasing the cam follower into engagement with said cam, and wherein said latch means locks said linkage means from following said cam under the action of said spring means whereby the vacuum-actuated first gripper of said second feed means is maintained in a position in which it supports a pile of signatures in said second hopper when signatures in the hopper are not to be removed therefrom.

* * * * *

UNITED STATES PATENT OFFICE

CERTIFICATE OF CORRECTION

Patent No. 3,953,018 Dated April 27, 1976

Inventor(s) Bernard J. Maopolski

It is certified that error appears in the above-identified patent and that said Letters Patent are hereby corrected as shown below:

In claim 3, line 10, after "the" delete "means linkage" and add --linkage means--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*